US006454875B1

(12) United States Patent
Vogel

(10) Patent No.: US 6,454,875 B1
(45) Date of Patent: Sep. 24, 2002

(54) GOLF CLUB CLEANING APPARATUS

(75) Inventor: Donald Darold Vogel, Jackson, MI (US)

(73) Assignee: Pro Club Cleaner, L.L.C., Ann Arbor, MI (US)

( * ) Notice: Subject to any disclaimer, the term of this patent is extended or adjusted under 35 U.S.C. 154(b) by 0 days.

(21) Appl. No.: 09/407,833

(22) Filed: Sep. 28, 1999

Related U.S. Application Data

(60) Provisional application No. 60/141,782, filed on Jun. 30, 1999.

(51) Int. Cl.[7] ..... A47L 25/00

(52) U.S. Cl. ..... 134/32; 134/151; 134/34; 134/199; 15/104.92; 15/88.1; 15/77; 211/70.2

(58) Field of Search ..... 15/104.92, 104.9, 15/77, 88.1, 88.2, 21.1, 3.14; 134/198, 199, 151, 32, 34; 211/70.2, 86.01

(56) References Cited

U.S. PATENT DOCUMENTS 798,186 A * 8/1905 Karlss ..... 134/198
1,178,817 A * 4/1916 Murton ..... 134/198
1,246,556 A 11/1917 Crow
1,765,647 A 6/1930 Boehnke
2,187,891 A * 1/1940 Poluzzi ..... 134/198
2,563,652 A 8/1951 Le Gore
2,617,132 A * 11/1952 Goller ..... 15/160
2,904,265 A 9/1959 Lyman
3,066,336 A * 12/1962 Stobbe
3,098,250 A * 7/1963 Creech
3,101,089 A 8/1963 Brown et al.
3,148,396 A * 9/1964 Smith ..... 15/88.3
3,332,099 A * 7/1967 Reiter
3,538,927 A 11/1970 Wallgreen
3,619,841 A * 11/1971 Russell et al. ..... 15/21.1
3,694,847 A * 10/1972 Metmon et al. ..... 15/77
3,757,806 A * 9/1973 Bhaskar et al. ..... 134/198
3,872,534 A 3/1975 Hoag
3,918,987 A * 11/1975 Kopfer ..... 134/199
4,069,536 A 1/1978 Hartz et al.
4,380,839 A 4/1983 Caradonna
4,452,264 A 6/1984 Kreisel et al.
4,472,851 A 9/1984 Kinsey
4,502,175 A * 3/1985 Hillis ..... 15/104.92
4,541,138 A 9/1985 Varrial
4,676,839 A 6/1987 Osborn
4,750,230 A 6/1988 Osborn
4,757,831 A 7/1988 Ingermann et al.
4,762,139 A 8/1988 Timmes et al.
4,821,358 A 4/1989 Wyckoff et al.
4,938,933 A 7/1990 Perrot
4,940,349 A 7/1990 van Rensburg
4,944,063 A 7/1990 Jordan
4,951,339 A 8/1990 Braun
4,957,129 A 9/1990 Kraft et al.
5,044,036 A * 9/1991 Fujimoto et al. ..... 15/88.1
5,168,888 A 12/1992 Altwasser
5,385,160 A * 1/1995 Brinkman ..... 134/186
5,560,066 A 10/1996 McDivitt
5,666,684 A 9/1997 Cussen
5,742,965 A 4/1998 Leask
5,787,539 A 8/1998 Nussbaum
6,299,000 B1 * 10/2001 Cabrera ..... 211/70.2

* cited by examiner

*Primary Examiner*—Gary K. Graham
(74) *Attorney, Agent, or Firm*—Young & Basile, P.C.

(57) ABSTRACT

An apparatus for cleaning golf clubs having an enclosure with a lower reservoir for holding water and an upper spray chamber in communication with said lower reservoir. The spray chamber houses a cleaning path for cleaning golf clubs. The cleaning path is defined by a plurality of opposingly spaced bristle brushes with a plurality of high pressure spray nozzles strategically located between the bristle brushes. A low volume/high pressure pump is utilized for providing highly pressurized fluid to the spray nozzles. Golf clubs are inserted along the cleaning path of the apparatus wherein all portions of the golf club are cleaned through the use of the bristle brushes and the high pressure spraying of fluid.

15 Claims, 3 Drawing Sheets

GOLF CLUB CLEANING APPARATUS

This application claims the benefit of provisional application No. 60/141,782, filed Jun. 30, 1999.

FIELD OF THE INVENTION

The present invention relates to a golf club cleaning apparatus for cleaning golf clubs, and in particular, a golf club cleaning apparatus that utilizes high pressure spray and bristle brushes to clean the heads, grooves, and grips of golf clubs.

BACKGROUND OF THE INVENTION

When the game of golf is played, golf club heads quickly become soiled through contact with dirt, mud, grass, and the like. The lines or grooves in the hitting surface of the head of the golf club are quickly and easily clogged with dirt and/or grass. Such lines or grooves of a golf club should be kept clean in order that they may function properly. The grooves or lines on the face of the golf club bite into the surface of the ball and impart spin to it which is necessary for the ball to fly accurately. Backspin is especially important when using the mid to short irons in terms of getting the ball to "hold" on the greens. A good clean surface on the face of the golf club provides friction against the dimpled exterior of the ball that enables the golfer to hook or fade the ball accurately which he or she cannot do if the surface is dirty, grass stained and slick. In addition, some of the foreign matter which adheres to the various surfaces of the golf club head can cause corrosion or pitting of the head which further impairs its accuracy and appearance. Chemicals frequently used for fertilizing the grass of a golf course are highly corrosive, especially when they are damp, and-therefore, such chemicals may add to the corrosion or pitting of the golf club head. Likewise, oils from the hands of a golfer may build up on the grips of the golf club thereby making the grips slick. The failure to properly grip the golf club may create a loss of power in a golfer's swing or create inaccuracies in a golf shot through the accidental turning of the golf club head.

Golf clubs are typically cleaned at home or in a club house using a bucket or sink full of water and a rag and a hand brush for scrubbing the golf club heads. Such cleaning is a laborious and time consuming process which may or may not effectively clean the entire golf club.

Many efforts have been made to provide a golf cleaning apparatus that solves the problem of having to use a rag and a bucket of water to clean golf clubs. Previous designs have utilized closely aligned stationary brushes with and without cleaning solutions to clean golf clubs. Typically, the golf clubs are manually and vigorously asserted against the brushes thus imparting undesirable forces against the golf clubs. Such apparatus' are typically messy and not especially effective in completely cleaning the golf clubs. In addition, these types of designs usually do not clean the grips of golf clubs.

Further designs have attempted to created a more efficient and effective cleaning apparatus by developing power operated washers for cleaning, scrubbing, polishing, etc. the striking surface as well as the remainder of the golf clubs. Such designs have utilized motor driven cylindrical cleaning brushes which rotate or drive against the golf club in order to clean the golf club. These systems may or may not utilize cleaning solutions. The problem with such systems is that they are complicated, mechanically detailed, involved a number of moving parts, and typically require a high degree of maintenance.

Other powered systems have utilized high pressure spray systems to spray a cleaning solution onto the golf clubs. Such known high pressure systems rotate the spray nozzles or the golf clubs relative to one another in order to clean the golf heads with a high pressure spray. Again, the problem with such systems is that they are complicated, mechanically detailed systems that involve a number of moving parts requiring regular and frequent maintenance. In addition, none of these systems have utilized high pressure spray to clean the grips of golf clubs.

It is desirable to provide a golf club cleaning apparatus which overcomes the disadvantages of the golf club cleaning apparatus' of the prior art, which is simple and low in maintenance, and which thoroughly and properly cleans all portions of a golf club.

SUMMARY OF THE INVENTION

The present invention provides a golf club cleaning apparatus for cleaning the heads, grooves, and grips of a golf club. The golf cleaning apparatus provides an enclosure with an opening therein for receiving an end of a golf club. The enclosure houses a cleaning path extending from the opening and defining a path of travel for the manual insertion of the golf club. The cleaning path is further defined by a plurality of opposing, stationary bristle brushes that are sufficiently spaced for guiding a golf club along the cleaning path. A plurality of high pressure, stationary spray nozzles are strategically located along the cleaning path for cleaning the head, grooves, and grip of the golf club. A high pressure, low volume pump provides a high pressure fluid to the high pressure spray nozzles.

The spray nozzles are properly mounted to insure that all portions of the golf clubs are sufficiently cleaned. At least one of the spray nozzles is mounted at the end of the path of travel for cleaning the bottom of the golf club head. At least another one of the spray nozzles is directed toward the grooves of the golf club head, and at least one other spray nozzle is located toward the opening of the enclosure for cleaning the grips of the golf club.

A first positive stop is provided at the end of the cleaning path to prohibit the golf club from being inserted beyond the cleaning path. A second positive stop is located substantially midway along the path of travel to prohibit the insertion of large heads of golf clubs beyond the midway portion of the cleaning path.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENT

Figure 1:
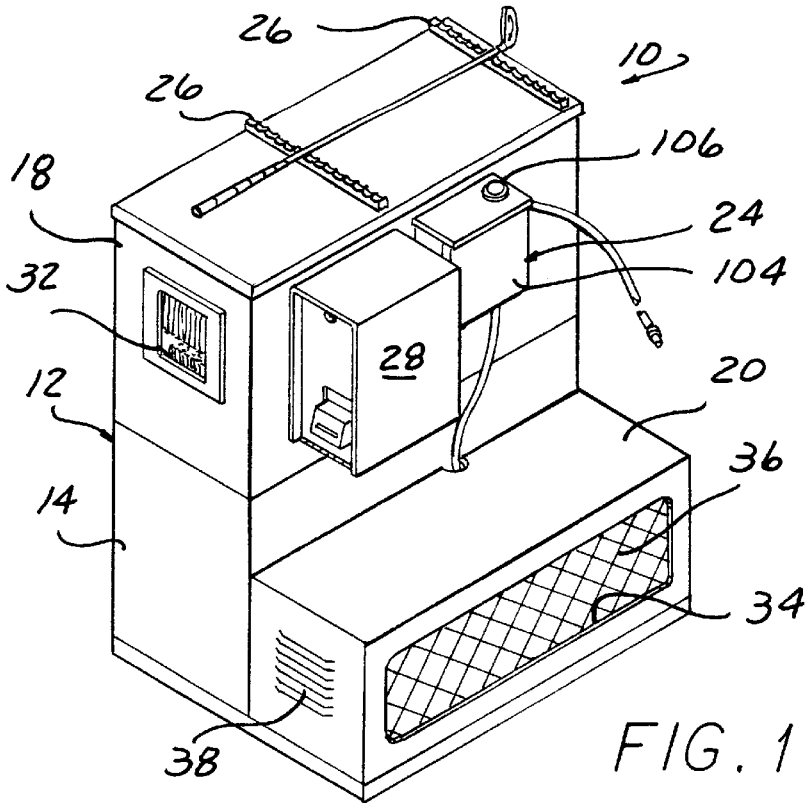
FIG. 1 is a perspective view of the golf club cleaning apparatus.

FIGS. 1–4 show a golf club cleaning apparatus 10 of the present invention.

The apparatus provides an enclosure 12 having a lower reservoir 14 for holding and containing forty gallons of water (not shown). Although various cleaning solutions may be utilized, the present invention is just as effective with water, thereby eliminating the cost of cleaning solutions. A drain plug 16 is provided in the bottom of the reservoir 14 for draining water from the reservoir 14. The upper portion of the enclosure houses a spray chamber 18 wherein golf clubs are inserted, cleaned, and removed. A pump housing 20 is provided adjacent the reservoir 14 of the enclosure 12, for housing a low volume/high pressure pump 22 that pumps water from the reservoir 14 to the spray chamber 18. A low level water indicator 24 may be mounted on a side of the spray chamber 18 of the enclosure 12 to provide an indication as to when the water level within the reservoir 14 becomes too low. A golf club rack 26 may also be provided on the top of the spray chamber 18 of the cabinet 12 to allow for the holding and drying of the golf clubs during and after cleaning. The golf club rack 26 comprises two substantially parallel plastic molded strips having semi-circular recesses formed therein for receiving the shafts of golf clubs. A dollar bill or coin validator 28 may also be attached to the side of the spray chamber 18 of the enclosure 12 for charging golfers a fee for the use of the apparatus 10.

To provide a durable, lightweight, modular apparatus 10, the enclosure 12 is fabricated from fourteen gage steel which is electrostatically powder coated on both the inside surface and the outside surface of the enclosure 12. The enclosure 12 is a hollow, rectangular enclosure wherein the reservoir 14 and the spray chamber 18 are divide by a lip or a shoulder 30 that extends inwardly from the interior walls of the enclosure 12. The spray chamber 18 has an opening 32 at one of its ends to provide access for the insertion of golf clubs. The pump housing 20 is also fabricated from fourteen gage steel that is electrostatically powder coated on both its inside surface and its outside surface. The pump housing 20 is attached to a side of the reservoir 14, and the outward side of the pump housing 20 has an opening 34 with a fencing 36 extending across the opening 34. The fencing 36 allows for ventilation and cooling of the pump 22. Further vents 38 are provided in the ends of the pump housing 20.

Figure 3:
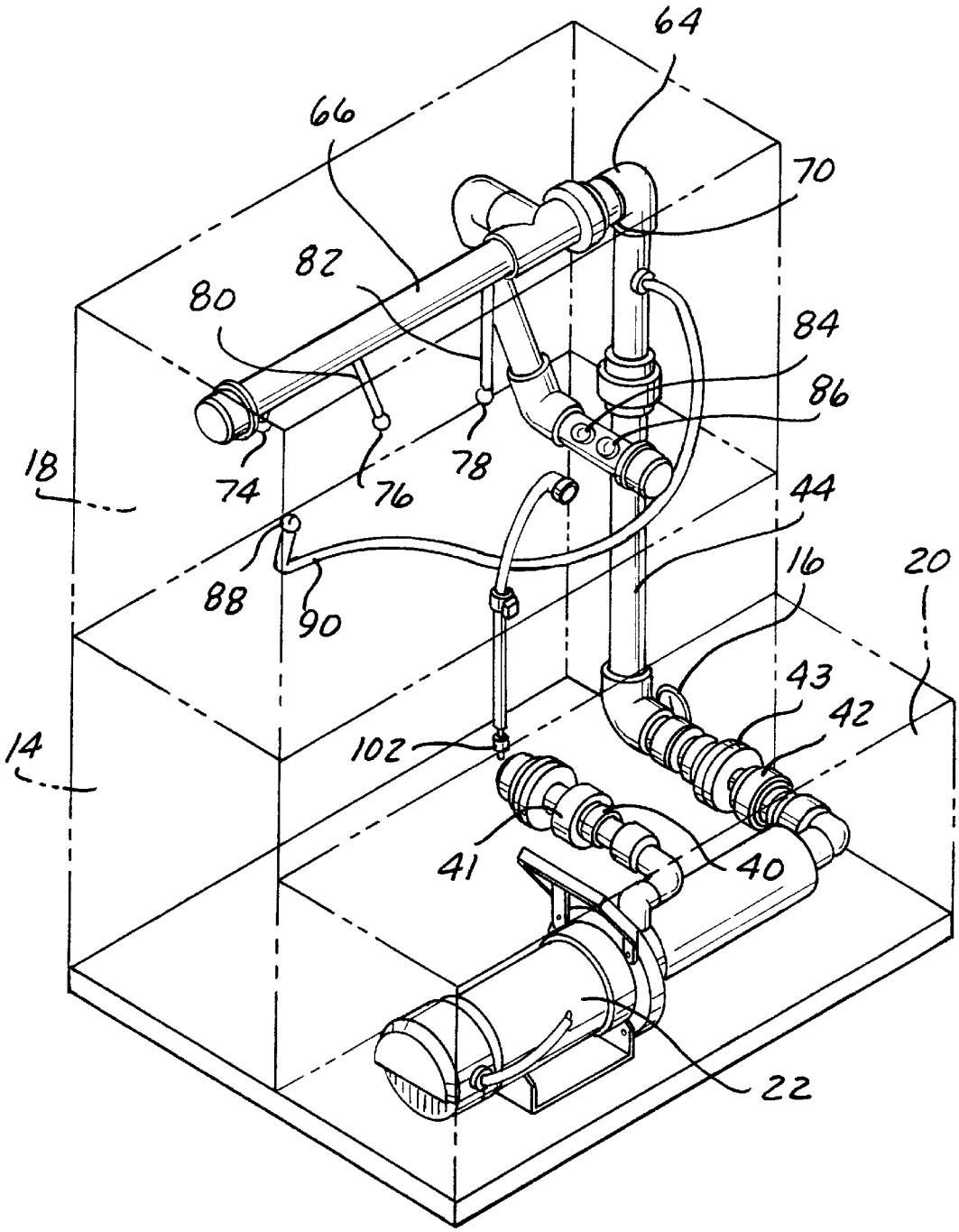
FIG. 3 is a perspective view of the fluid communication portion of the apparatus.

In order to provide a high pressure cleaning of golf clubs, the low volume/high pressure booster pump 22 provides highly pressurized water to the spray chamber 18. The pump 22 is a twelve stage pump wherein pressure is built up over twelve stages of The pump 22 is similar to that provided by F.E. Myers, Inc., model PB718S. As seen in FIG. 3, the pump 22 has an inlet 40 and an outlet 42 extending to and from the reservoir 14 of the enclosure 12. The inlet 40 and outlet 42 have threaded couplings 41, 43, respectively, so that the pump 22 may be easily disassembled from and assembled to the reservoir 14. The inlet 40 of the pump 22 is in direct communication with the water in the reservoir 14 whereby the water is gravity fed to the inlet 40 of the pump 22. The outlet 42 of the pump 22 leads into the reservoir 14 of the cabinet 12 and is in communication with a vertical PVC pipe 44 which directs pressurized water to the spray chamber 18 of the cabinet 12. The pump 22 provides a head pressure of 100 psi with a variance of ±10% depending on the variance of the power supply and the cleanliness of the water.

Figure 2:
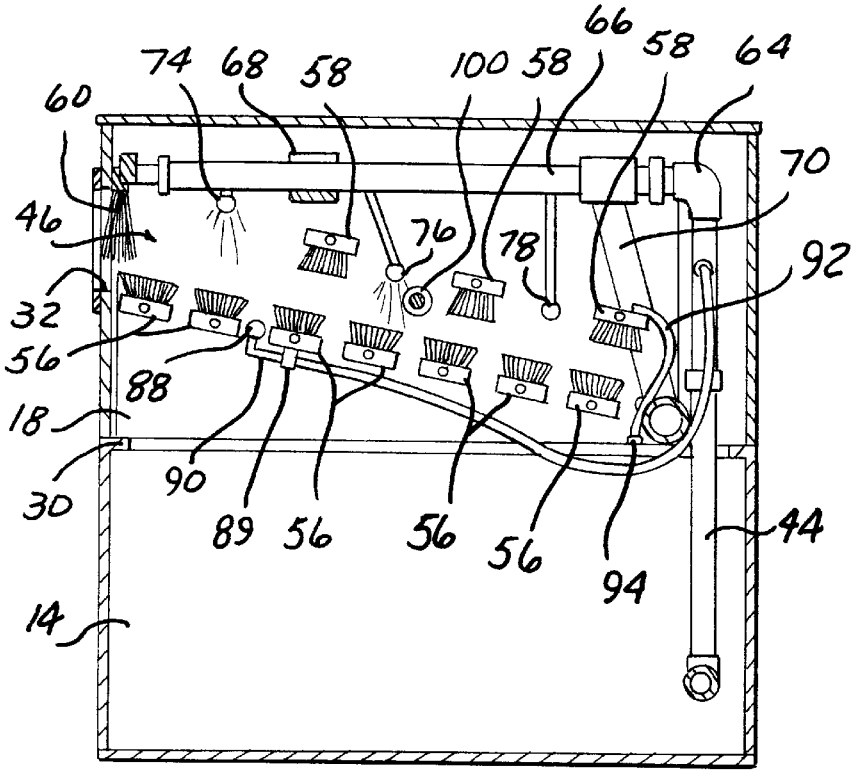
FIG. 2 is a sectional view of the spray chamber of the golf cleaning apparatus.
Figure 4:
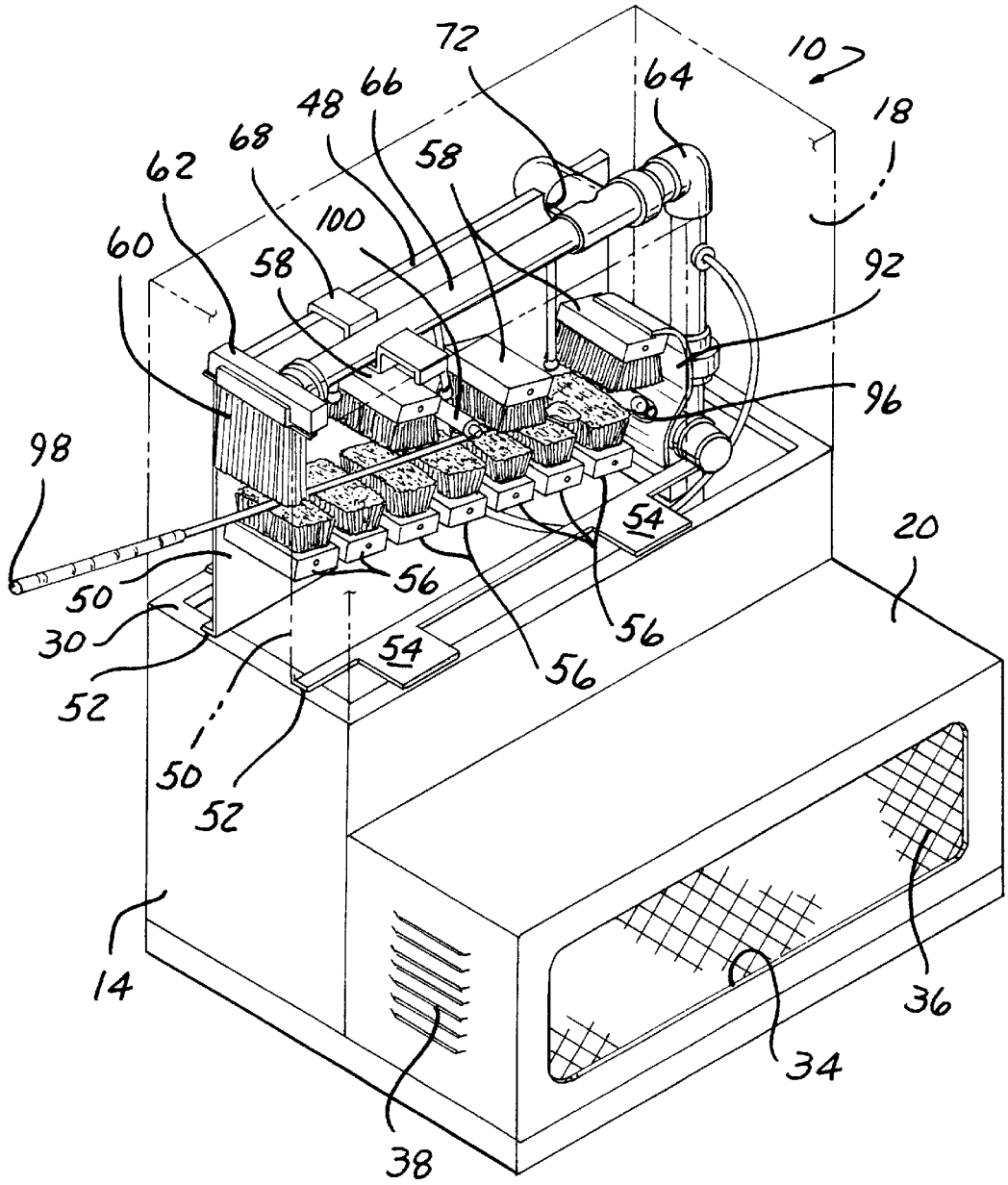
FIG. 4 is a perspective view with a portion cut away showing the cleaning path of the apparatus.

To clean the golf clubs, a cleaning path 46 is provided in the spray chamber 18 of the enclosure 12, as seen in FIGS. 2 and 4. The cleaning path 46 is defined by a rectangular frame 48 that is disposed within the spraying chamber 18 of the enclosure 12. The frame 48 comprises two substantially parallel upright sides 50 extending upright in the spray chamber 18. The sides 50 of the frame 48 each have a bottom side 52 that extends integrally from and substantially perpendicular to the sides 50 of the frame 48. The bottom sides 52 extend outwardly away from each other, and each bottom side 52 has a pair of extending portions or feet 54 that extend across the spray chamber 18 and engage the inwardly extending shoulder 30 that divides the reservoir 14 from the spray chamber 18. The bottom sides 52 engage the shoulder 30 in the enclosure 12 and support the frame 48 within the spray chamber 18. The frame 48 is modular relative to the enclosure 12 thereby providing for ease of disassembly and assembly of the frame 48 to the spray chamber 18.

To provide a path of travel for the cleaning of the golf clubs, a plurality of bristle brushes 56, 58 are mounted between the two upright sides 50 of the frame 48. Seven upwardly extending bristle brushes 56 are mounted adjacent one another at a slight downward angle with their bristles facing upward. Three downwardly extending bristle brushes 58 oppose the upwardly extending bristle brushes 56 and are mounted at similar downward angles as the upwardly extending bristle brushes 56. The opposing bristle brushes 56, 58 are spaced approximately 1–1½ inches apart with the bristle brushes 56, 58 toward the end of the path of travel 46 spaced less than those toward the beginning of the path of travel 46. The bristle brushes 56, 58 are connected to the sides 50 of the frame 48 by having threaded fasteners extend through the sides 50 of the frame 48 into the wooden handle portions of the bristle brushes 56, 58. The bristle brushes 56, 58 are ten inch pool brushes with polymer crimped bristles as manufactured by Bech, Inc. A single brush or brush curtain 60 having longer nylon bristles than the bristle brushes 56, 58 is mounted at the top of the frame 48 by having its plastic handle 62 connected to the top of the sides 50 of the frame 48. The longer nylon bristles extend downward immediately behind the opening or entrance 32 into the spray chamber 18. The brush curtain 60 prevents the sprayed water from escaping the spray chamber 18. The bristles brushes 56, 58 and brush curtain 60 provide the distinct advantage of being stationary so as to reduce the need for maintenance through the elimination of moving parts.

To direct high pressure water to the spray chamber 18, the PVC pipe 44 extends upwardly from the outlet 42 of the pump 22 into the spray chamber 18 of the enclosure 12, as seen in FIGS. 2–4. The upwardly extending portion of the PVC pipe 44 extends to a PVC elbow pipe 64 which is coupled to a substantially horizontal PVC pipe 66 extending across the spray chamber 18. The substantially horizontal PVC pipe 66 is supported by a horizontal bracket 68 spanning across the sides 50 of the frame 48. A downwardly extending PVC pipe 70 also extends from the substantially horizontal PVC pipe 66 so as to direct pressurized water to the bottom of the golf club head. This downwardly extending PVC pipe 70 is received by a hemispherical recess 72 in one of the sides 50 of the frame 48 to aid in supporting the PVC piping structure. The PVC pipe 44, 64, 66, 70 is schedule 80 PVC having a 1¼" diameter.

To direct high pressure spray to other specific portions of the golf club, three high pressure spray nozzles 74, 76, 78 extend and spray downwardly from the horizontal PVC pipe 66. The first spray nozzle 74 is connected to and in communication with the horizontal PVC pipe 66 through an aperture (not shown) provided in the PVC pipe 66. The first spray nozzle 74 is located between the brush curtain 60 provided at the entrance 32 of the spray chamber 18 and the first downwardly extending bristle brush 58. The first spray nozzle 74 is utilized to initially spray the golf club and also to spray larger head golf clubs such as woods and drivers.

The second and third nozzles 76, 78 are designed to spray the grooves of the golf club head. The second and third spray nozzles 76, 78 are each connected to a rubber hose 80, 82 which extend downward from the horizontal PVC pipe 66 between the downwardly extending bristle brushes 58. The rubber hoses 80, 82 are connected to and in communication with the horizontal PVC pipe 66 through apertures (not shown) provided in the PVC pipe 66. The second and third spray nozzles 76, 78 are offset three degrees so as to apply different angles of spray to the grooves of the golf club head for enhanced cleaning. The rubber hoses 80, 82 are a ⅜" diameter push/lock rubber hose with a cotton carcass rated at 300 psi, as provided by Gates, Inc. Although the rubber hoses 80, 82 are stationary when in use, they will still bend when engaged by a golf club.

The fourth and fifth spray nozzles 84, 86 are provided in the downwardly extending PVC pipe 70. The fourth and fifth spray nozzles 84, 86 are adjacently mounted to and placed in communication with the PVC pipe 70 through corresponding apertures (not shown) in the PVC pipe 70. The fourth and fifth 84, 86 spray nozzles are mounted at an upward angle at the end of the cleaning path 46 so as to spray and clean the insignia and bottom portion of the golf club head.

A sixth spray nozzle 88 extends upward between two of the upwardly extending bristle brushes 56 toward the front of the cleaning path 46. The sixth spray nozzle 88 is mounted by C-clamp 89 to the wooden handle of one of the bristle brushes 56. A rubber hose 90 is connected to the sixth spray nozzle 88 and extends to the vertical PVC pipe 44 where it is connected to and placed in communication with the PVC pipe 44. The rubber hose 90 is the same ⅜" diameter push/lock rubber hose as previously described. The sixth spray nozzle 88 is utilized to clean the grips of the golf club.

All six spray nozzles 74, 76, 78, 84, 86, 88 are fabricated from glass filled Delron. The spray nozzles 74, 76, 78, 84, 86, 88 have a maximum flow rate of 10 gallons per minute and displace pressurized fluid at a 65° spray angle. The spray nozzles 74, 76, 78, 84, 86, 88 also have the advantage of being stationary so as to reduce the need for maintenance caused by moving parts.

In order to limit the distance in which a golf club can be inserted into the spray chamber 18, a piece of conveyor belting 92 is placed at the end of the cleaning path 46 to positively stop the golf club from extending too far into the spray chamber 18. The conveyor belting 92 is connected to the wooden handle of the most inward downwardly extending bristle brush 58. The opposite end of the conveyor belting 92 is connected to a small rectangular plastic block 94 which is connected to the bottom of the sides 50 of the frame 48. The conveyor belting 92 also has an oval aperture 96 which correspondingly aligns with the fourth and fifth spray nozzles 84, 86 to allow for unobstructed spraying of pressurized water by the fourth and fifth spray nozzles 84, 86.

In operation, the pump 22 is actuated, and water from the reservoir 14 is gravity fed to the inlet 40 of the pump 22. The pump 22 displaces highly pressurized water through the pump outlet 42 and into the PVC piping system 44, 64, 66, 70 of the apparatus 10 to provide highly pressurized water to the spray nozzles 74, 76, 78, 84, 86, 88. A golf club 98 is inserted face up through the opening 32 provided in the spray chamber 18 of the enclosure 12 and inserted into the spray chamber 18 at a slightly downward angle along the cleaning path 46. The golf club head is pushed along the ends of the bristle brushes 56, 58 to aid in the cleaning of the golf club 98 and to properly align the golf club 98 with respect to the spray nozzles 74, 76, 78, 84, 86, 88. The first and sixth spray nozzles 74, 88, respectively, provide an initial spraying of the golf club head, and the second and third spray nozzles 76, 78 provide a high pressure spray cleaning of the grooves of the golf club head. The golf club head continues to be inserted into the spray chamber 18 wherein the fourth and fifth spray nozzles 84, 86 apply a high pressure spray to the bottom of the golf club head to clean the insignia of the golf club head. If the golf club 98 is inserted the full length of the cleaning path 46, the golf club head will abut the conveyor belting 92. The golf club 98 is then withdrawn from the spray chamber 18 at the same angle as it was inserted and placed on the golf club rack 26 on the top of the spray chamber 18 for drying. After the pressurized water is sprayed, the sprayed water falls from the spray chamber 18 into the reservoir 14 where it is recycled into the system.

To clean the grips of the golf club 98, the grip end of the golf club 98 is inserted and rotated at a slight downward angle into the opening 22 provided in the spray chamber 18 of the enclosure 12. The first and sixth spray nozzles 74, 88 both provide a high pressure spray of water to the grip of the golf club 98, but the sixth nozzle 88 is specifically designed to provide a high pressure spray to the grips of the golf club 98. The grip end of the golf club 98 is then withdrawn from the spray chamber 18.

To clean large golf club heads such as woods and/or drivers, a positive stop 100 is provided along the cleaning path 46 of the spray chamber 18 to prevent large headed golf heads from becoming wedged within the tighter spaced bristle brushes 56, 58 toward the end of the cleaning path 46. The positive stop 100 is a rubber coated rod which extends between and is connected to the upright sides 50 of the frame 48. The rod 100 is mounted high enough from the upwardly extending bristle brushes 56 so as to allow for golf club heads of irons to pass under the rod 100, and the rod 100 is mounted low enough to prohibit any larger head golf clubs, such as woods and/or drivers, from being inserted past the rod 100. To clean larger headed golf clubs, the head of the golf club 98 is inserted into the opening 32 of the spray chamber 18, and the first and sixth spray nozzles 74, 88 wash the head of the golf club 98. The first spray nozzle 74 is specifically designed to clean the grooves of the larger headed golf clubs.

As seen in FIGS. 1 and 3, the low level water indicator 24 may be provided to indicate that the water level in the reservoir 14 has become dangerously low with respect to the pump 22. The low level water indicator 24 has an electronic sensor 102 that senses a minimum desired water level within the reservoir 14. The electronic sensor 102 is coupled to a control panel 104 which receives the signal from the sensor 102. If a signal corresponding to a low level of water is provided, the control panel 104 provides an indicator that the water is low, such as the light 106 provided on the top of the control panel 104, and the pump 22 automatically disengages. This prevents the pump 22 from cavitating and becoming damaged due to a low supply of water.

The bill and/or coin validator 28 may also be provided in order that a fee may be charged for the use of the golf cleaning apparatus 10. Once money is inserted into the dollar and/or coin validator 28, the pump 22 is actuated, and the user is given a sufficient time period to clean his golf clubs 98. A conventional adjustable timer is utilized to maintain a standard amount of time by which the apparatus 10 may operate. At the end of the timing cycle, power to the pump 22 is disengaged, and a new cycle will begin by inserting the proper dollar bills and/or coins. Alternatively, a conventional "on-off" switch may be utilized instead of the bill and/or coin validator 28.

While the invention has been described in connection with what is presently said to be the most practical and preferred embodiment, it is to be understood that the invention is not to be limited to the disclosed embodiment but, on the contrary, it is intended to cover various modifications and equivalent arrangements included within the spirit and scope of the appended claims, which scope is to be accorded the broadest interpretations so as to encompass all such modifications and equivalent structure as is permitted under the law.

What is claimed is:

1. A golf club cleaning apparatus for cleaning golf clubs having heads, grooves and grips comprising:

a single chamber enclosure having a single opening for manually inserting and removing said golf clubs;

a cleaning path defined by a plurality of opposingly spaced, stationary bristle brushes, and said cleaning path extending from said opening and into said enclosure, and defining a path of travel, having a beginning and an end, for the manual insertion and removal of said golf clubs;

a plurality of high pressure, stationary spray nozzles strategically mounted along said cleaning path for cleaning said heads, grooves and grips; and said plurality of opposingly spaced stationary bristle brushes spaced less toward the end of said path of travel than toward the beginning of said path of travel.

2. A golf club cleaning apparatus for cleaning golf clubs having heads, grooves and grips comprising:

a single chamber enclosure having a single opening therein;

a plurality of opposed and adjacent stationary bristle brushes extending from said opening and into said enclosure, and said bristle brushes defining a path of travel, having a beginning and an end, for guiding said golf club through the manual insertion and removal of said golf club;

a plurality of high pressure, stationary spray nozzles strategically mounted between said adjacent bristle brushes along said path of travel for cleaning said heads, grooves and grips of said golf clubs; and said opposed bristle brushes being spaced less toward the end of said path of travel than those toward the beginning of said path of travel.

3. A golf club cleaning apparatus for cleaning golf clubs having heads, grooves and grips comprising:

an enclosure having an opening therein;

a plurality of stationary bristle brushes extending from said opening and into said enclosure, and said bristle brushes defining a path of travel for the manual insertion and removal of said golf clubs;

a plurality of high pressure, stationary spray nozzles strategically mounted along said path of travel for cleaning said head, grooves, and grips of said golf clubs;

a first positive stop mounted at the end of said path of travel opposite said opening and said enclosure for prohibiting said golf clubs from extending beyond said cleaning path; and a second positive stop located substantially midway along said path of travel for prohibiting the insertion of large heads of said golf clubs beyond said positive stop.

4. A golf club cleaning apparatus for cleaning golf clubs having heads, grooves, and grips comprising:

an enclosure having an opening therein;

a plurality of stationary bristle brushes extending from said opening and into said enclosure and said bristle brushes defining a path of travel for the manual insertion and removal of said golf clubs;

a plurality of high pressure stationary spray nozzles strategically mounted along said path of travel for cleaning said heads, grooves and grips of said golf clubs; and a rack mounted to said enclosure for holding said golf clubs prior to and after the manual insertion of said golf clubs into said golf club cleaning apparatus.

5. A golf club cleaning apparatus for cleaning golf clubs having heads, grooves, and grips, comprising:

an enclosure having a single chamber with a single opening therein for inserting and removing said golf clubs from said enclosure;

a plurality of opposed and adjacent stationary bristle brushes extending from said opening and into said enclosure, and said opposing bristle brushes defining a downward path of travel relative to a horizontal plane for the manual insertion and removal of said golf clubs wherein said path of travel has a beginning and an end with said opposing bristle brushes spaced less toward said end of said path of travel than said beginning;

a plurality of high pressure, stationary spray nozzles strategically mounted between said adjacent bristle brushes along said path of travel for cleaning said heads, grooves, and grips of said golf clubs; and a high pressure, low volume pump in communication with said high pressure spray nozzles for providing a highly pressurized fluid to said spray nozzles.

6. The golf club cleaning apparatus stated in claim 5, wherein said spray nozzles further comprise:

at least one of said spray nozzles mounted at the end of said path of travel for cleaning a bottom of said head of said golf club;

at least one of said spray nozzles mounted substantially midway along said path of travel for cleaning said grooves of said head of said golf club; and at least one of said spray nozzles located toward said opening of said enclosure for cleaning said grips of said golf club.

7. The golf club cleaning apparatus as stated in claim 6, further comprising:

a pair of said spray nozzles directed at said grooves of said head of said golf club, and said pair of said spray nozzles offset with respect to one another to provide different angles of spray at said grooves of said head of said golf club.

8. The golf club cleaning apparatus as stated in claim 5, wherein said enclosure further comprises:

a spray chamber having said bristles brushes and said spray nozzles disposed therein; and a reservoir in fluid communication with said spray chamber for accumulating and holding said fluid for said pump.

9. The golf club cleaning apparatus as stated in claim 8, further comprising:

a low level fluid indicator connected to said enclosure for indicating a low level of fluid in said reservoir.

10. The golf club cleaning apparatus as stated in claim 5, further comprising: said spray nozzles providing a spray of said fluid at substantially 100 PSI.

11. The golf club cleaning apparatus as stated in claim 5, further comprising:

said spray nozzles providing a spray of fluid defined by a pair of rays extending from said spray nozzle wherein said rays are separated at a substantially 65° angle.

12. A golf cleaning apparatus for cleaning golf clubs having heads, grooves and grips, comprising:

an enclosure having an opening therein;

a plurality of stationary bristle brushes extending from said opening and into said enclosure, and said bristle brushes opposing one another in a substantially parallel and spaced manner to define a path of travel for the manual insertion and removal of said golf clubs;

a plurality of high pressure, stationary spray nozzles strategically mounted between said bristle brushes along said path of travel for cleaning said heads, grooves and grips of said golf clubs;

a high pressure, low volume pump in communication with a high pressure spray nozzles for providing a highly pressurized fluid to said spray nozzles;

a first positive stop mounted at the end of said path of travel opposite said opening and said enclosure for prohibiting said golf clubs from extending beyond said cleaning path; and a second positive stop located substantially midway along said path of travel for prohibiting the insertion of large heads of said golf clubs beyond said midway of said path of travel.

13. A golf club cleaning apparatus for cleaning golf clubs having heads, grooves and grips, comprising:

an enclosure having an opening therein;

a plurality of stationary bristle brushes extending from said opening and into said enclosure, and said bristle brushes opposing one another in a substantially parallel and spaced manner to define a path of travel for the manual insertion and removal of said golf clubs;

a plurality of high pressure, stationary spray nozzles strategically mounted between said bristle brushes along said path of travel for cleaning said heads, grooves and grips of said golf clubs;

a high pressure, low volume pump in communication with a high pressure spray nozzles for providing a highly pressurized fluid to said spray nozzles; and a rack mounted to the top of said enclosure and having a pair of substantially parallel rails with hemispherical recesses formed therein for receiving said shafts and grips of said golf clubs prior to and after the manual insertion of said golf clubs into said golf cleaning apparatus.

14. A golf club cleaning apparatus for cleaning golf clubs having heads, grooves, and grips comprising;

an enclosure having an opening therein;

a cleaning path extending from said opening and into said enclosure and defining a path of travel for the manual insertion and removal of said golf clubs;

a plurality of high pressure, stationary spray nozzles strategically mounted along said cleaning path for cleaning said heads, grooves, and grips of said golf clubs; and a rack mounted to said enclosure for mounting said golf clubs prior to and after the manual insertion of said golf clubs into said golf cleaning apparatus.

15. A method for cleaning a golf club having heads, grooves and grips comprising:

inserting said golf club into an enclosure having a single chamber and a single opening therein;

guiding said golf club along a cleaning path wherein said cleaning path is defined by a plurality of opposedly and adjacently spaced bristle brushes;

spraying said golf club with a plurality of high pressure spray nozzles strategically mounted between said adjacently mounted bristle brushes; and withdrawing said golf club from said enclosure.

* * * * *

UNITED STATES PATENT AND TRADEMARK OFFICE

CERTIFICATE OF CORRECTION

PATENT NO. : 6,454,875 B1
DATED : September 24, 2002
INVENTOR(S) : Vogel

It is certified that error appears in the above-identified patent and that said Letters Patent is hereby corrected as shown below:

Column 1,
Line 53, delete “apparatus” and insert -- apparatuses --.
Line 65, delete “involved” and insert -- involve --.

Column 2,
Line 13, delete “apparatus” and insert -- apparatuses --.

Column 3,
Line 44, insert -- the pump. -- after the words “stages of”

Signed and Sealed this

Fourteenth Day of January, 2003

JAMES E. ROGAN
*Director of the United States Patent and Trademark Office*